United States Patent [19]

Del Giudice

[11] Patent Number: 4,860,629

[45] Date of Patent: Aug. 29, 1989

[54] GRAPHITE TROMBONE SLIDE

[76] Inventor: James E. Del Giudice, 5774 Halloween Ave., Las Vegas, Nev. 89119

[21] Appl. No.: 226,187

[22] Filed: Jul. 28, 1988

[51] Int. Cl.[4] ..... G10D 7/10

[52] U.S. Cl. ..... 84/395; 84/452 P

[58] Field of Search ..... 84/395, 396, 452 R, 84/452 P

[56] References Cited

U.S. PATENT DOCUMENTS

| | | | |
|---|---|---|---|
| 2,027,340 | 1/1936 | Holton | 84/395 |
| 2,106,327 | 1/1938 | Olds | 84/395 |
| 2,730,002 | 1/1956 | Legler | 84/395 |
| 2,929,292 | 3/1960 | Greenleaf et al. | 84/388 |
| 3,835,748 | 9/1974 | Olson | 84/388 |
| 4,015,501 | 4/1977 | Schaller | 84/282 |
| 4,145,948 | 3/1979 | Turner | 84/293 |
| 4,210,056 | 7/1980 | Ciccarelli | 84/392 |
| 4,320,688 | 3/1982 | Donohoe | 84/422 S |

*Primary Examiner*—Lawrence R. Franklin

*Attorney, Agent, or Firm*—Quirk, Tratos & Roethel

[57] ABSTRACT

A trombone has an other slide member fabricated from graphite tube. The graphite tube is 60–66% graphite and 40–34% expoxy resin and has a wall thickness in the range between 0.023 and 0.029 inches. The resulting trombone is lightweight and durable, resistant to bending or denting of the tube and has a smooth slide action.

18 Claims, 1 Drawing Sheet

GRAPHITE TROMBONE SLIDE

BACKGROUND OF THE INVENTION

The present invention relates to trombone slides, and more particularly to trombone slides having a graphite construction.

Typical trombones are made from brass. The slide portion of the trombone comprises an outer generally U-shaped tubular slide member that telescopes over an inner tubular slide member. The telescoping feature permits the trombone player to vary the length of the path that the air travels from the mouthpiece to the bell. By varying the length of the air path, the trombone player can create sounds having different pitch and tonal quality.

A distinct disadvantage of the use of brass for the inner and outer slides is the possibility of damage to the slide if the trombone is dropped or bumped into other objects, either during play or at other times. Many musicians are not as careful with their instruments as they should be. A trombone is a staple of high school and college orchestras and marching bands. It is a common occurrence for a trombone to be dropped or to be bumped into other instruments when a marching band is performing its maneuvers. If the slide is damaged, the trombone becomes inoperable until it is repaired. Dents in the tubing of the slide in effect act as a crimp. A dented slide tubing will prevent the outer slide from telescoping over the inner side.

It is an object of the present invention to mitigate the possibility of a trombone becoming dented or bent and thus rendered inoperable. It is a further object of the present invention to reduce the overall weight of a trombone.

It is a feature of the present invention to fabricate the outer slide member of a trombone from graphite tubing.

It is an advantage of the present invention that an outer slide member of a trombone fabricated from graphite will resist denting when a trombone is dropped or bumped into other objects. Collisions that previously would have dented a brass trombone slide and rendered the trombone inoperable will have no denting effect on the trombone of the present invention. The trombone will remain operable even in the hands of the average youthful player who fails to exercise reasonable care in the use of his trombone. The attendant lighter weight of the trombone will also make the trombone easier to carry and play thereby increasing its appeal to even the youngest aspiring musician.

BRIEF DESCRIPTION OF THE INVENTION

A graphite tube is used as the outer slide member of a trombone. Two straight graphite tube segments are joined together by a brass crook end piece to form the outer slide member which telescopes over the brass inner slide member. The resulting trombone is lighter and more durable and dent resistant than a conventional all brass trombone.

DETAILED DESCRIPTION OF THE PREFERRED EMBODIMENTS

Figure 1:
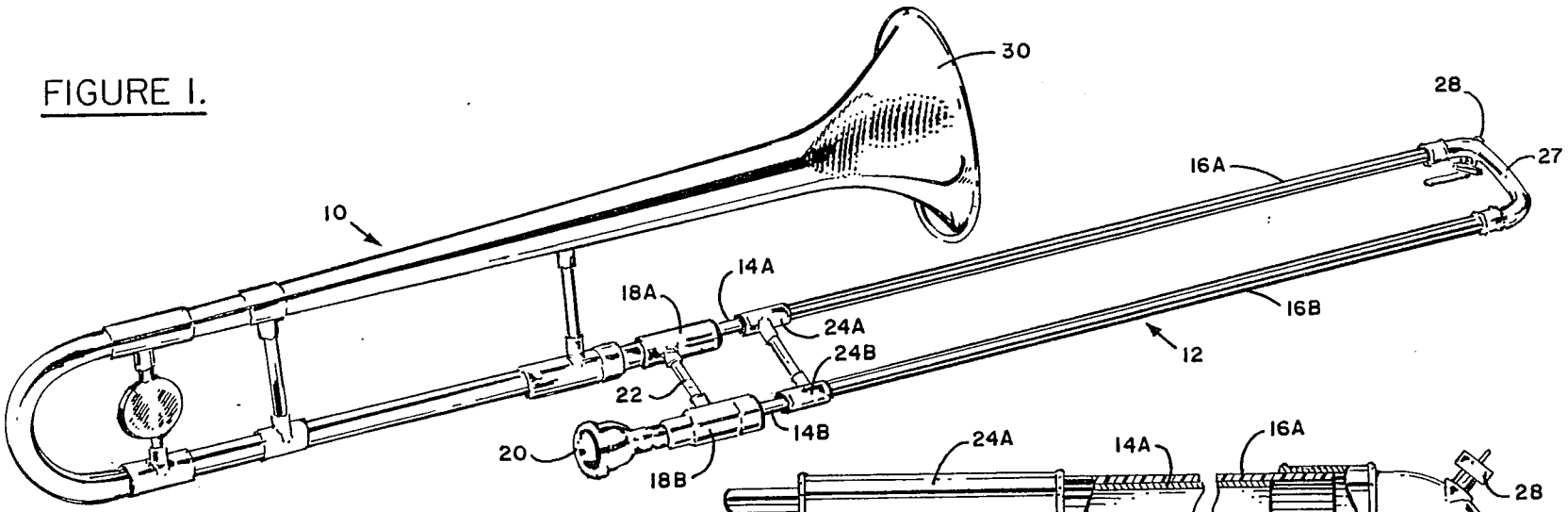
FIG. 1 shows a trombone of the present invention having a graphite slide.

A trombone constructed in accordance with the teachings of the present invention is shown at 10 in FIG. 1. The slide 12 comprises an inner slide member 14A, B and an outer slide member 16A, B. The inner slide member 14A, B is fabricated of brass and comprises two tubes—an upper inner slide tube 14A and a lower inner slide tube 14B. One end of the upper inner slide tube 14A is connected to the body of the trombone in a conventional manner by means of an upper inner slide bracket 18A. Similarly, one end of the lower inner slide tube 14B is connected to the mouthpiece 20 in a conventional manner by means of a lower inner slide bracket 18B. An inner slide crosspiece 22 provides a bracing support between the inner slide brackets 18A, B.

Figure 2:
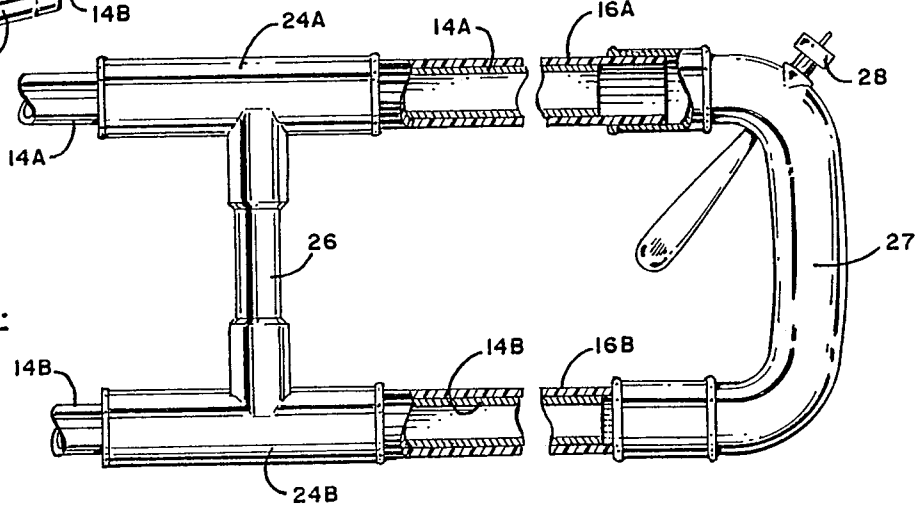
FIG. 2 is a partial cutaway view of the slide portion of the trombone of the present invention.

As shown in detail in FIG. 2, the outer slide member 16A, B comprises two graphite tubes——an upper outer slide tube 16A and a lower outer slide tube 16B. One end of each of the outer slide members 16A, B is connected to an upper and lower outer slide bracket 24A, B in a conventional manner. An outer slide crosspiece 26 provides a bracing support between the outer slide brackets 24A, B. The opposite remote ends of the outer slide members 16A, B are each cemented to a brass end crook 27 by using an epoxy cement with a hardening agent. The end crook 27 also has a water key 28 mounted thereon.

As shown in FIG. 2, the inner slide member 14A, B telescopes within the outer slide member 16A, B. The effective length of the trombone slide can thus be varied to effect different tonal sounds emitting from the bell 30 of the trombone 10 during play.

While the remainder of the trombone is fabricated from brass, which is conventional, the outer slide member 16A, B is made out of graphite tube. Graphite in a tape form (available from Fiberite Corporation, Winona, Minn.) is impregnated with an epoxy resin. The epoxy resin is any typical heat activated, thermoset resin. After the graphite tape has been impregnated with the resin, the tape is cut into a predetermined pattern shape. The tape is then rolled around a mandrel, at room temperature, into the shape of a tube. The predetermined pattern shape is selected so that when the tape is rolled around the mandrel, a tube having a uniform thickness results. The tape can be rolled around the mandrel at any suitable angle to the mandrel axis, but preferably a roll angle of either 90° or 45° is utilized. A polypropylene shrink tape is then applied to the outer surface of the graphite tube. The shrink tape prevents the resin from leaking off the graphite tape during the curing step.

The graphite tube is then cured in an oven at a temperature of approximately 250° F. Following curing, the shrink tape is removed and the graphite tube is trimmed to its final length. The tube is then assembled as each of the upper and lower outer slide members 16A, B. In its normal finished state, the graphite tube has a dull, black surface appearance but it may be polished or painted if a different surface finish is desired.

The graphite tape impregnated with the epoxy resin has a composition of approximately 60–66% graphite and 40–34% epoxy resin. Preferably unidirectional graphite fibers are used; most preferably fibers of a uniform length. This provides the resulting tube with good strength characteristics. The graphite tape is generally between 0.0055 and 0.0063" thick and the wall thickness of the resulting tube is generally approximately 0.026" ±003". The preferred length of each of the graphite outer slide tube 16A, B is approximately 27".

Trombones come in various sizes. A soprano trombone is the smallest; followed by an alto trombone, a tenor trombone, a baritone trombone and a bass trombone which is the largest. The outer slide tube 16A, B of the present invention when used in a tenor trombone will have an inside diameter of approximately 0.543" and an outer diameter of approximately 0.595". In trombones that are smaller than a tenor trombone, the inside and outside diameters of the outer slide tube will be proportionately smaller. Likewise, in trombones that are larger than a tenor trombone, the inside and outside diameters of the outer slide tube will be proportionately larger.

A trombone having graphite outer slide members 16A, B has considerable advantages over the conventional brass outer slide tubes. The use of graphite outer slides reduces the overall weight of a trombone. A typical brass slide weighs approximately 212.5 grams whereas the graphite slide of the present invention weighs only approximately 131.3 grams. By replacing both the upper outer slide member and the lower outer slide member a net weight reduction of approximately 162.4 grams is achieved.

Trombones are typically played by the musician in a standing or sitting position. It is not unusual for the trombone to be dropped or bumped into other instruments, musicians or objects on the stage, especially during particularly energetic performances such as those done by jazz, pop, rock or school groups. Trombones are also susceptible to damage when used by performers in marching bands.

The typical damage is a dent or bend to the slide element of the trombone. Also, if the trombone is dropped on its end, the slide will bow out slightly. Because the inner slide telescopes within the outer slide, any dent, bow or bend to the slide will render the trombone inoperable because the sliding action will be inhibited at the dented, bowed or bent location. The dent, bow or bend will have to be repaired or even rebored, which actually thins the metal, making the repaired product even more susceptible to further damage.

By using a graphite tube as the outer slide member the trombone slide becomes very highly resistant to denting, bowing or bending. The graphite tube is quite resistant to impact forces and the act of dropping a trombone from approximately shoulder level to a wooden stage floor will not dent, bow or bend a graphite slide whereas a brass slide would be dented, bowed or bent.

The graphite tube of the outer slide also slides much easier than a brass when telescoping over the brass tube of the inner slide. This results in smoother action of the slide during the playing of the trombone.

These advantages yield a trombone that is much easier to play than the conventional all brass trombone. The smoother action and lighter weight make the trombone of the present invention more suitable for school players and professional players to play and use. The durability and resistance to denting, bowing and bending reduces costly repair bills and non-playing time while the instrument is being repaired which also makes the trombone more suitable for children.

While the present invention has been described in connection with a trombone slide, a graphite tube slide member can be used with any musical instrument that has telescoping inner and outer slide tubes, such as a slide trumpet (soprano trombone).

While the invention has been illustrated with respect to several specific embodiments thereof, these embodiments should be considered as illustrative rather than limiting. Various modifications and additions may be made and will be apparent to those skilled in the art. Accordingly, the invention should not be limited by the foregoing description, but rather should be defined only by the following claims.

I claim:

1. A trombone comprising:

a) a body member having a bell, a slide and a mouthpiece, b) said slide comprising an inner slide member and an outer slide member which telescopes over the inner slide member, c) said inner slide member comprising an upper inner slide tube connected to the body member of the trombone by an upper inner slide bracket and a lower inner slide tube connected to the body member of the trombone by a lower inner slide bracket, d) said outer slide member comprising an upper outer slide tube connected to an upper outer slide bracket and a lower outer slide tube connected to a lower outer slide bracket, e) the upper outer slide tube and the lower outer slide tube being fabricated from graphite tube.

2. The trombone of claim 1 wherein the graphite tube is 60–66% graphite and 40–34% epoxy resin.

3. The trombone of claim 1 wherein the graphite tube has a wall thickness generally in a range between 0.023 and 0.029 inches.

4. The trombone of claim 1 wherein the graphite tube is 60–66% graphite and 40–34% epoxy resin and has a wall thickness in a range between 0.023 and 0.029 inches.

5. The trombone of claim 1 wherein the graphite tube has an inside diameter of approximately 0.543" and an outside diameter of approximately 0.595".

6. A trombone comprising an outer slide member fabricated from graphite tube.

7. The trombone of claim 6 wherein the graphite tube is 60–66% graphite and 40–34% epoxy resin.

8. The trombone of claim 6 wherein the graphite tube has a wall thickness generally in a range between 0.023 and 0.029 inches.

9. The trombone of claim 6 wherein the graphite tube is 60–66% graphite and 40–34% epoxy resin and has a wall thickness in a range between 0.023 and 0.029 inches.

10. A trombone slide comprising:

a) an inner slide member and an outer slide member which telescopes over the inner slide member, b) the inner slide member comprising an upper inner slide tube and a lower inner slide tube, c) the outer slide member comprising an upper outer slide tube and a lower outer slide tube, d) the upper outer slide tube and the lower outer slide tube being fabricated from graphite tube.

11. The trombone slide of claim 10 wherein the graphite tube is 60–66% graphite and 40–34% epoxy resin.

12. The trombone slide of claim 10 wherein the graphite tube has a wall thickness generally in a range between 0.023 and 0.029 inches.

13. The trombone slide of claim 10 wherein the graphite tube is 60–66% graphite and 40–34% epoxy resin and has a wall thickness in a range between 0.023 and 0.029 inches.

14. A slide member for a musical instrument comprising an inner slide member and an outer slide member which telescopes over the inner slide member, the outer slide member fabricated from graphite tube.

15. The slide member of claim 14 wherein the inner slide member comprises an upper inner slide tube and a lower inner slide tube and the outer slide member comprises an upper outer slide tube and a lower outer slide tube.

16. The slide member of claim 14 wherein the graphite tube is 60–66% graphite and 40–34% epoxy resin.

17. The slide member of claim 14 wherein the graphite tube has a wall thickness generally in a range between 0.023 and 0.029 inches.

18. The slide member of claim 14 wherein the graphite tube is 60–66% graphite and 40–34% epoxy resin and has a wall thickness in a range between 0.023 and 0.029 inches.

* * * * *